US010245833B2

(12) United States Patent
Tanaka

(10) Patent No.: US 10,245,833 B2
(45) Date of Patent: Apr. 2, 2019

(54) LIQUID EJECTING HEAD AND METHOD OF MANUFACTURING LIQUID EJECTING HEAD

(71) Applicant: SEIKO EPSON CORPORATION, Tokyo (JP)

(72) Inventor: Shuichi Tanaka, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/860,348

(22) Filed: Jan. 2, 2018

(65) Prior Publication Data

US 2018/0117912 A1 May 3, 2018

Related U.S. Application Data

(62) Division of application No. 15/006,756, filed on Jan. 26, 2016, now Pat. No. 9,889,655.

(30) Foreign Application Priority Data

Mar. 10, 2015 (JP) ..... 2015-046946

(51) Int. Cl.
*B41J 2/16* (2006.01)
*B41J 2/14* (2006.01)

(52) U.S. Cl.
CPC ..... *B41J 2/161* (2013.01); *B41J 2/1433* (2013.01); *B41J 2/14233* (2013.01); *B41J 2/162* (2013.01);

(Continued)

(58) Field of Classification Search
CPC ..... B41J 2/1643
See application file for complete search history.

(56) References Cited

U.S. PATENT DOCUMENTS 5,870,289 A 2/1999 Masahide
6,783,652 B2 8/2004 Iijima et al.
(Continued)

FOREIGN PATENT DOCUMENTS

JP 2000289201 10/2000
JP 2002103602 4/2002
(Continued)

OTHER PUBLICATIONS

Notice of Allowance issued in U.S. Appl. No. 15/006,756 dated Oct. 23, 2017.

(Continued)

*Primary Examiner* — Shelby L Fidler
(74) *Attorney, Agent, or Firm* — Workman Nydegger

(57) ABSTRACT

A liquid ejecting head and a method of manufacturing the liquid ejecting head are provided. The liquid ejecting head has a pressure-chamber-forming substrate that includes a plurality of piezoelectric elements and that is connected to a first surface of a sealing plate, a driver IC that outputs signals that drive the piezoelectric elements and that is provided on a second surface of the sealing plate that is on the opposite side to the first surface, and a power supply wire that supplies electrical power to the piezoelectric elements, that is formed in the second surface of the sealing plate, and that has at least one portion thereof embedded in the sealing plate and a surface thereof exposed on the second surface side.

3 Claims, 6 Drawing Sheets

(52) U.S. Cl.
CPC ..... *B41J 2/1623* (2013.01); *B41J 2/1625* (2013.01); *B41J 2/1628* (2013.01); *B41J 2/1629* (2013.01); *B41J 2/1631* (2013.01); *B41J 2/1632* (2013.01); *B41J 2/1635* (2013.01); *B41J 2/1642* (2013.01); *B41J 2/1643* (2013.01); *B41J 2/1646* (2013.01); *B41J 2002/1425* (2013.01); *B41J 2002/14362* (2013.01); *B41J 2002/14491* (2013.01); *B41J 2202/18* (2013.01)

(56) References Cited

U.S. PATENT DOCUMENTS

| | | | |
|---|---|---|---|
| 8,985,734 | B2 | 3/2015 | Kondo |
| 2002/0066672 | A1 | 6/2002 | Iijima et al. |
| 2003/0030705 | A1 | 2/2003 | Shuji et al. |
| 2004/0001122 | A1 | 1/2004 | Miyata |
| 2005/0275694 | A1 | 12/2005 | Murata et al. |
| 2006/0164466 | A1 | 7/2006 | Mizuno |
| 2006/0209138 | A1 | 9/2006 | Yasuhiko |
| 2006/0232640 | A1 | 10/2006 | Ota |
| 2006/0237229 | A1 | 10/2006 | Sugahara |
| 2006/0268047 | A1 | 11/2006 | Ota |
| 2007/0049130 | A1 | 3/2007 | Kojima |
| 2007/0097154 | A1 | 5/2007 | Kojima |
| 2008/0111859 | A1 | 5/2008 | Hirofumi |
| 2008/0236890 | A1 | 10/2008 | Sugahara |
| 2008/0239006 | A1 | 10/2008 | Matsuno et al. |
| 2014/0092167 | A1 | 4/2014 | Nishi et al. |
| 2014/0132677 | A1* | 5/2014 | Kondo ..... B41J 2/14233 347/81 |
| 2016/0263887 | A1 | 9/2016 | Tanaka |
| 2016/0263890 | A1 | 9/2016 | Hamaguchi |
| 2016/0276571 | A1 | 9/2016 | Tanaka |
| 2017/0210133 | A1 | 7/2017 | Tsukahara |

FOREIGN PATENT DOCUMENTS

| | | |
|---|---|---|
| JP | 2002-171048 | 6/2002 |
| JP | 2003-204140 | 7/2003 |
| JP | 2007142026 | 6/2007 |
| JP | 2011115972 | 6/2011 |

OTHER PUBLICATIONS

Office Action issued in U.S. Appl. No. 15/000,6756, filed Jun. 30, 2017.
Office Action issued in U.S. Appl. No. 15/006,756 dated Mar. 2, 2017.
Office Action issued in U.S. Appl. No. 15/006,756 dated Oct. 14, 2016.
European Search Report for Application No. 16153671.9 dated Aug. 12, 2016.

* cited by examiner

LIQUID EJECTING HEAD AND METHOD OF MANUFACTURING LIQUID EJECTING HEAD

BACKGROUND

1. Technical Field

The present invention relates to a liquid ejecting head including a wiring substrate on which wires to be connected to a driver IC have been formed and a method of manufacturing the liquid ejecting head.

2. Related Art

As liquid ejecting apparatuses including liquid ejecting heads, for example, there exist image recording devices such as ink jet printers, ink jet plotters and the like, however, recently, liquid ejecting apparatuses have been applied to various manufacturing devices by utilizing their advantage of being able to make a minute amount of liquid precisely land onto a designated position. For example, liquid ejecting apparatuses have been applied to display manufacturing devices that manufacture color filters of liquid crystal displays and the like, electrode forming devices that form electrodes of organic electroluminescence (EL) displays, field emission displays (FEDs) and the like, and chip manufacturing devices that manufacture biochips. In addition, a recording head for image recording devices ejects liquid ink, and a color material ejecting head for display manufacturing devices ejects solutions of individual color materials of red (R), green (G), and blue (B). Moreover, an electrode material ejecting head for electrode forming devices ejects a liquid electrode material and a bioorganic matter ejecting head for chip manufacturing devices ejects a solution of bioorganic matter.

The above-described liquid ejecting heads are formed by stacking a pressure-chamber-forming substrate formed of pressure chambers that communicate with nozzles, piezoelectric elements (a type of driver element) that cause a change in pressure in the liquid inside the pressure chambers, a sealing plate which is arranged so as to be separated at a distance from the piezoelectric elements, and the like. The above-described piezoelectric elements are each driven by a driving signal that is supplied from a driver IC. This driver IC, in the related art, is arranged outside the liquid ejecting head. For example, there is known a liquid ejecting head in which a driver IC is provided on a flexible substrate that connects to the liquid ejecting head (for example, JP-A-2011-115972).

To date, with the reduction in the size of liquid ejecting heads, techniques for joining a driver IC onto a sealing plate that covers piezoelectric elements have been developed. In such a structure, a wire that supplies electrical power to the driver IC is formed on a surface on one side (driver IC side) of the sealing plate. If, with nozzle densification, the number of nozzles increases, the electrical power supplied to the driver IC also increases. Consequently, reducing the electrical resistance (hereinafter simply called resistance) of the wire formed on the sealing plate has been considered. However, to date, when the width of the wire has been increased in order to lower the resistance of the wire, the wire area has become large. Consequently, it has been difficult to decrease the resistance of the wire without changing the size of the sealing plate.

SUMMARY

An advantage of some aspects of the invention is that a liquid ejecting head capable of decreasing the resistance of a wire formed on a wiring substrate such as a sealing plate as well as decreasing the wire area is provided, and a method of manufacturing the liquid ejecting head is provided.

A liquid ejecting head according to an aspect of the invention has a wiring substrate having a first surface that is connected to a driver-element-forming substrate in which a plurality of driver elements are provided, and a second surface that is on the opposite side to the first surface and that is provided with a driver IC that outputs signals that drive the driver elements, wherein a wire that supplies electrical power to the driver elements is formed in the second surface of the wiring substrate, and at least one portion of the wire is embedded in the wiring substrate and a surface of the wire is exposed on the second surface side.

According to this configuration, because the wire is embedded in the wiring substrate, it is possible to increase the cross-sectional area of the wire without increasing the width of the wire. As a result, it is possible to reduce the resistance of the wire. Moreover, because it is possible to reduce the width of the wire as much as desired, the degree of freedom of the layout of the wire is improved and consequently the wire area can be made smaller. Moreover, because the surface of the wire is exposed on the second surface side, it is possible to connect power supply bump electrodes of the driver IC directly to the top of the wire without having to additionally provide terminals to the wire. As a result, the wire distance can be reduced and the wire resistance can be reduced.

Moreover, in the above-described configuration, it is preferable that the wire be formed of an embedded wire that is composed of a conductive material and that is embedded inside the wiring substrate, and an outer layer wire that is composed of a conductive material that is different from the conductive material of the embedded wire, the outer layer wire covering the second surface side of the embedded wire.

According to this configuration, it is possible to suppress a change in the electrical characteristics of the embedded wire due to environmental changes. Moreover, it is possible to suppress breakage of the embedded wire due to migration or the like. Consequently, it is possible to provide a liquid ejecting head having high reliability.

Furthermore, in each of the above-described configurations, the driver IC has a plurality of circuit blocks that generate signals that individually drive the driver elements and a plurality of bump electrodes that connect to the circuit blocks in a first direction, and it is preferable that the wire extend in the first direction and be connected to the plurality of bump electrodes.

According to this configuration, because the wire and the circuit blocks are connected by the plurality of bump electrodes that are formed along the first direction, which is a direction parallel to the circuit blocks, a decrease in the electrical power supplied to each of the circuit blocks can be suppressed. Consequently, it is possible to make the amounts of power supplied to the individual parallelly arranged circuit blocks substantially equal.

Moreover, a method of manufacturing a liquid ejecting head according to an aspect of the invention is a method of manufacturing a liquid ejecting head that includes a wiring substrate having a first surface that is connected to a driver-element-forming substrate in which a plurality of driver elements are provided and a second surface that is on the opposite side to the first surface and that is provided with a driver IC that outputs signals that drive the driver elements, a wire in the second surface that supplies electrical power to the driver elements, and a through wire that extends between the first surface and the second surface, the method including processing a wiring substrate so as to form a recessed portion that is recessed in the second surface of the wiring substrate in a thickness direction thereof and a through hole that penetrates through the wiring substrate, and forming the wire by filling a conductive material into the recessed portion and the through wire by filling the conductive material into the through hole.

According to this method, it is possible to manufacture a wire that is embedded inside the wiring substrate. Consequently, it is possible to increase the cross-sectional area of the wire without increasing the width of the wire. Moreover, because it is possible to form the wire and the through wire using the same method, the manufacturing of the wiring substrate becomes easy. Furthermore, it is possible to reduce the manufacturing costs of the wiring substrate.

In the above-described method, it is preferable that, in the wire forming, the conductive material be formed in the recessed portion and the through hole by electroplating.

According to this configuration, it is possible to form the wire and the through wire more easily. As a result, the manufacturing of the wiring substrate becomes even easier. Moreover, it is possible to further reduce the manufacturing costs of the wiring substrate.

It is preferable that each of the above-described methods include forming an outer layer wire that covers the second surface side of the wire embedded in the wiring substrate with a conductive material that is different from the conductive material of the wire embedded in the wiring substrate.

According to this configuration, it is possible to suppress a change in the electrical characteristics of a wire due to environmental changes. Moreover, it is possible to suppress breakage of a wire due to migration or the like. Consequently, it is possible to provide a liquid ejecting head having high reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, modes for carrying out the invention will be described with reference to the accompanying drawings. The embodiment described below is a preferred embodiment of the invention, and even though various limitations are imposed, the scope of the invention is not intended to be limited to these limitations unless there is a particular description that limits the invention in the following description. Moreover, hereinafter, an ink jet printer (hereinafter, printer), which is one type of liquid ejecting apparatus mounted with an ink jet recording head (hereinafter, recording head), which is one type of liquid ejecting head, according to the invention will be described as an example.

Figure 1:
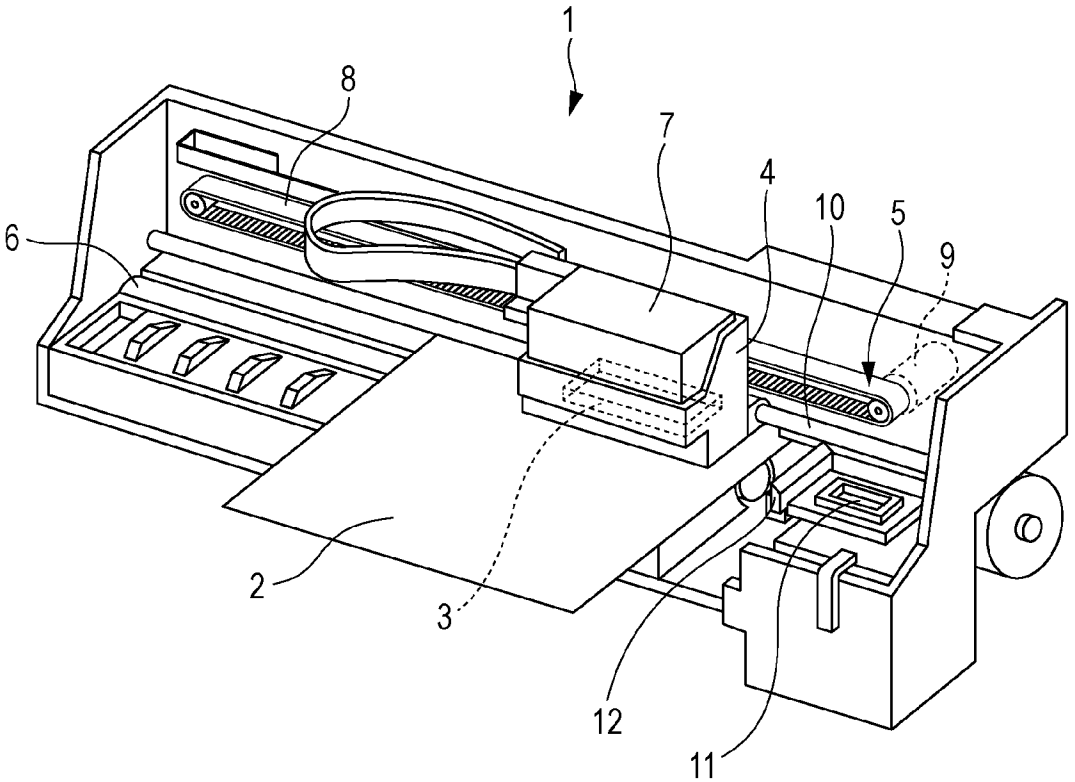
FIG. 1 is a perspective diagram illustrating a structure of a printer.

The structure of a printer 1 will be described with reference to FIG. 1. The printer 1 is an apparatus that performs recording of an image or the like by ejecting ink (a type of liquid) onto a surface of a recording medium 2 (a type of landing target) such as recording paper. The printer 1 has a recording head 3, a carriage 4 to which the recording head 3 is attached, a carriage moving mechanism 5 that moves the carriage 4 in a main scanning direction, a transport mechanism 6 that transports the recording medium 2 in a sub-scanning direction, and the like. Here, the above-described ink is stored in an ink cartridge 7 that functions as a liquid supply source. The ink cartridge 7 is detachably attached to the recording head 3. Further, the ink cartridge is arranged in the body of the printer, and has a structure that enables the recording head to be supplied with ink from the ink cartridge by an ink supply tube.

The carriage moving mechanism 5 has a timing belt 8. The timing belt 8 is driven by a pulse motor 9 such as a DC motor. Therefore, when the pulse motor 9 operates, the carriage 4 is guided by a guide rod 10 that is installed in the printer 1 and reciprocates in the main scanning direction (the width direction of the recording medium 2). The position of the carriage 4 in the main scanning direction is detected by a linear encoder (not illustrated), which is a type of positional information detection device. The linear encoder transmits a detection signal, that is, an encoder pulse (a type of positional information) to a control unit of the printer 1.

Moreover, a home position that represents the starting point of the scanning of the carriage 4 is set in an end region that is outside the recording region in the range of movement of the carriage 4. In this home position, a cap 11 that seals nozzles 22 that are formed in a nozzle surface (a nozzle plate 21) of the recording head 3 and a wiping unit 12 for wiping the nozzle surface are arranged in order from the end side.

Figure 2:
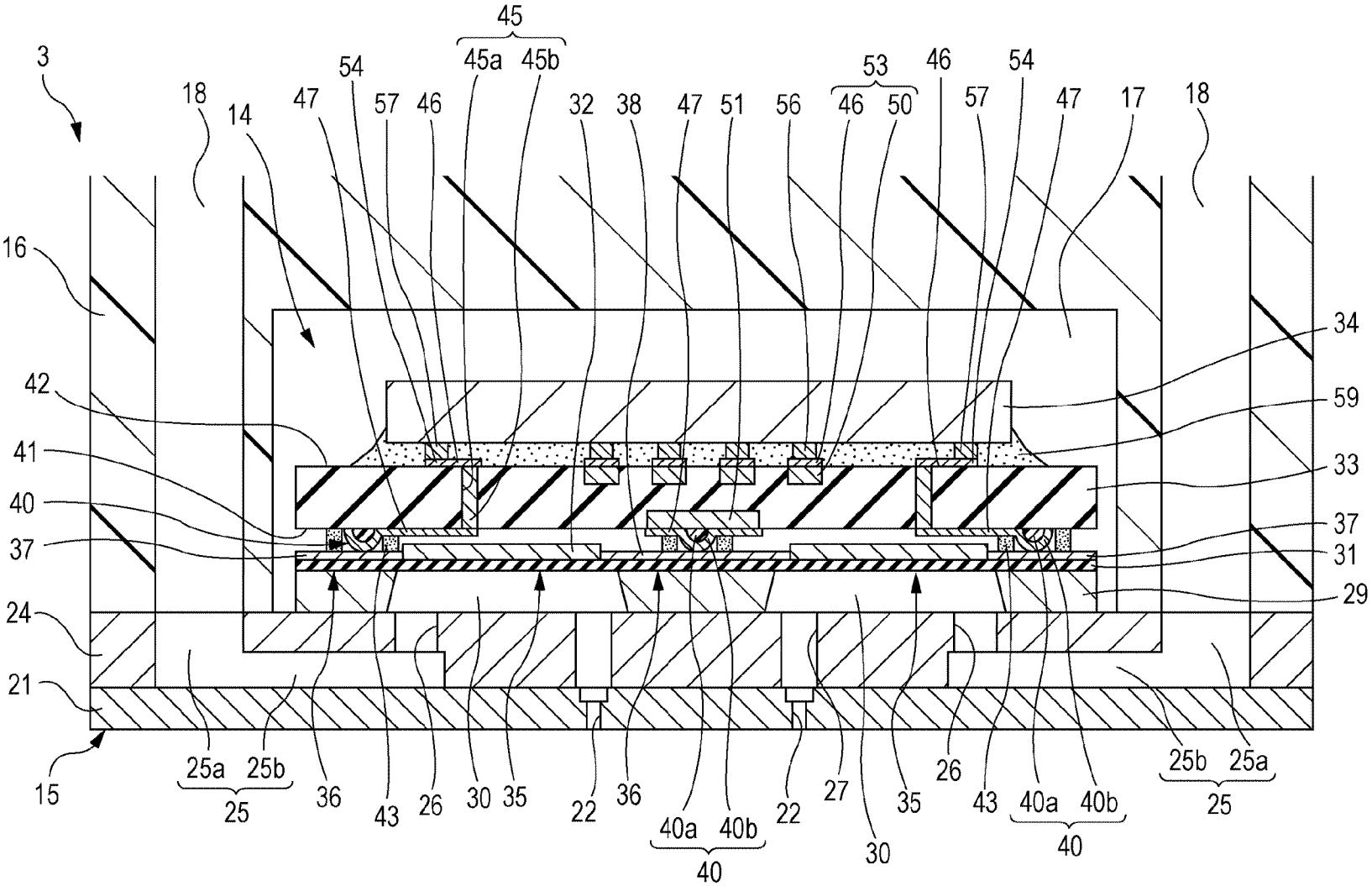
FIG. 2 is a cross-sectional diagram illustrating a structure of a recording head.

Next, a description of the recording head 3 will be given. FIG. 2 is a cross-sectional diagram depicting the structure of the recording head 3. The recording head 3 of this embodiment is, as shown in FIG. 2, attached to a head case 16 in which an electronic device 14 and a flow path unit 15 are stacked. Moreover, for convenience, the stacking direction of individual members is described as the vertical direction.

The head case 16 is a box shape member composed of a synthetic resin, and reservoirs 18 that supply ink to individual pressure chambers 30 are formed therein. The reservoirs 18 are spaces in which ink common to a plurality of the pressure chambers 30 that are parallelly arranged is stored, and two are formed respectively corresponding to two rows of the pressure chambers 30 that are parallelly arranged. Further, an ink introduction path (not illustrated) for introducing ink from the ink cartridge 7 to the reservoirs 18 is formed above the head case 16. Moreover, a housing space 17 that has a hollow box shape is formed in the lower surface side of the head case 16 halfway up in the height direction of the head case 16 from the bottom surface thereof. When the flow path unit 15 to be described later is joined to the lower surface of the head case 16 while being positioned on the lower surface of the head case 16, the electronic device 14 (a pressure-chamber-forming substrate 29, a sealing plate 33, and the like) stacked on top of a communication substrate 24 is formed so as to be housed within the housing space 17.

The flow path unit 15 joined to the lower surface of the head case 16 includes the communication substrate 24 and the nozzle plate 21. The communication substrate 24 is a board made of silicon and, in this embodiment, is formed of a silicon single-crystal substrate, the crystal plane orientation of the surface (upper surface and lower surface) of which is the (110) plane. In the communication substrate 24, as shown in FIG. 2, communicating with the reservoirs 18, common liquid chambers 25 that store ink common to the pressure chambers 30, and separate communication paths 26 that separately supply ink from the reservoirs 18 along the common liquid chambers 25 to the pressure chambers 30 respectively are formed by etching. The common liquid chambers 25 are long spaces that extend along the nozzle row direction (corresponding to the first direction of the invention) and two are formed respectively corresponding to the two rows of the pressure chambers 30 that are parallelly arranged. The common liquid chambers 25 are formed of a first liquid chamber 25*a* which penetrates the communication substrate 24 in the thickness direction, and a second liquid chamber 25*b* which is hollow from the lower surface side of the communication substrate 24 toward the upper surface side until the middle of the communication substrate 24 in the thickness direction while leaving a thin plate portion on the upper surface side. A plurality of the separate communication paths 26 are formed in the thin plate portion of the second liquid chamber 25*b* along a direction parallel to the pressure chambers 30 so as to correspond to the pressure chambers 30. The separate communication paths 26 each communicate with an end portion of a corresponding one of the pressure chambers 30 on one side of the pressure chamber 30 in the length direction in a state where the communication substrate 24 and the pressure-chamber-forming substrate 29 are joined to each other.

Moreover, nozzle communication paths 27 that penetrate through the communication substrate 24 in the thickness direction are formed at positions corresponding to individual ones of the nozzles 22 of the communication substrate 24. That is, a plurality of the nozzle communication paths 27 are formed along the nozzle row direction of corresponding nozzle rows. The pressure chambers 30 and the nozzles 22 communicate with each other through the nozzle communication paths 27. The nozzle communication paths 27 of this embodiment each communicate with an end portion of a corresponding one of the pressure chambers 30 on the other side (the side opposite to the corresponding one of the separate communication paths 26) of the pressure chamber 30 in the longitudinal direction in a state where the communication substrate 24 and the pressure-chamber-forming substrate 29 are joined to each other.

The nozzle plate 21 is a silicon substrate (for example, a silicon single-crystal substrate) that is joined to the lower surface (the surface on the opposite side to the pressure-chamber-forming substrate 29) of the communication substrate 24. In this embodiment, the opening on the lower surface side of the space making up each of the common liquid chambers 25 is sealed by the nozzle plate 21. Moreover, the plurality of nozzles 22 are linearly arranged (in rows) in the nozzle plate 21. In this embodiment, the nozzles are arranged in two rows that correspond to the two rows of the pressure chambers 30. The parallelly arranged plurality of the nozzles 22 (nozzle rows) are arranged at equal intervals along the sub-scanning direction which is orthogonal to the main scanning direction at a pitch (for example, 600 dpi) corresponding to the dot resolution from one end of the nozzles 22 to the other end of the nozzles 22. Further, it is possible to join a nozzle plate to a communication substrate at regions away from the interior of common liquid chambers and seal the openings on the lower surface side of the common liquid chambers by using a member such as a compliance sheet that, for example, has flexibility. By doing this, the nozzle plate can be made as small as desired.

The electronic device 14 of this embodiment is a laminated device that functions as an actuator that causes a pressure change in the ink inside each of the pressure chambers 30. The electronic device 14 is, as shown in FIG. 2, a unit in which the pressure-chamber-forming substrate 29, a diaphragm 31, piezoelectric elements 32 (corresponding to the driver elements of the invention), the sealing plate 33, and a driver IC 34 are stacked. Further, the electronic device 14 is formed to be smaller than the housing space 17 so as to enable it to be housed within the housing space 17.

The pressure-chamber-forming substrate 29 is a hard board made of silicon and, in this embodiment, is formed of a silicon single-crystal substrate, the crystal plane orientation of the surface (upper surface and lower surface) of which is the (110) plane. In the pressure-chamber-forming substrate 29, portions are sufficiently removed in the thickness direction by etching so as to form a plurality of spaces, which are to become the pressure chambers 30 parallelly arranged along the nozzle row direction. These spaces are partitioned from below by the communication substrate 24 and from above by the diaphragm 31 so as to form the pressure chambers 30. Moreover, these spaces, namely, the pressure chambers 30, are formed in two rows corresponding to the two nozzle rows. Each of the pressure chambers 30 is a long space that extends in a direction orthogonal to the nozzle row direction, one end of which in the longitudinal direction communicates with a corresponding one of the separate communication paths 26 and the other end of which communicates with a corresponding one of the nozzle communication paths 27.

The diaphragm 31 is a thin-film-like member that has elasticity, and is stacked on the upper surface (the surface on the opposite side to the communication substrate 24) of the pressure-chamber-forming substrate 29. The upper portion openings of the spaces that are to become the pressure chambers 30 are sealed by the diaphragm 31. In other words, the pressure chambers 30 are partitioned by the diaphragm 31. Portions of the diaphragm 31 corresponding to the pressure chambers 30 (specifically the upper portion openings of the pressure chambers 30), function as deformable portions that deform with the flexure of the piezoelectric elements 32 in a direction away from the nozzles 22 and in a direction toward the nozzles 22. That is, the areas of the diaphragm 31 corresponding to the upper portion openings of the pressure chambers 30 become drive areas 35 where bending deformation is permitted. In contrast, the areas of the diaphragm 31 outside the upper portion openings of the pressure chambers 30 become non-drive areas 36 where bending deformation is inhibited.

Further, the diaphragm 31, for example, may be formed of an elastic film composed of silicon dioxide ($SiO_2$) formed on the upper surface of the pressure-chamber-forming substrate 29 and an insulating film composed of zirconium dioxide ($ZrO_2$) formed on the elastic film. Then, the piezoelectric elements 32 are individually stacked on areas of the insulating film (the surface of the diaphragm 31 on the opposite side to the pressure-chamber-forming substrate 29 side of the diaphragm 31) corresponding to the pressure chambers 30, namely, the drive areas 35. The piezoelectric elements 32 each correspond to one of the pressure chambers 30 parallelly arranged in two rows along the nozzle row direction and are formed in two rows along the nozzle row direction. Further, the pressure-chamber-forming substrate 29 and the diaphragm 31 stacked thereon correspond to the driver-element-forming substrate of the invention.

The piezoelectric elements 32 of this embodiment are so-called bend mode piezoelectric elements. The piezoelectric elements 32 are, for example, formed of lower electrode layers (separate electrodes), piezoelectric layers and upper electrode layers (common electrodes) stacked in order on the diaphragm 31. Each of the piezoelectric elements 32 formed in this way, when subjected to an electric field corresponding to the electrode potential difference between the lower electrode layer and the upper electrode layer, deforms in a direction away from a corresponding one of the nozzles 22 or in a direction toward a corresponding one of the nozzles 22. As shown in FIG. 2, the lower electrode layers that form the piezoelectric elements 32 form separate wires 37 that extend out to the non-drive areas 36 on the outer side of the piezoelectric elements 32. In contrast, the upper electrode layers that form the piezoelectric elements 32 form common wires 38 that extend to the non-drive areas 36 between the rows of the piezoelectric elements 32. That is, in the longitudinal direction of the piezoelectric elements 32, the separate wires 37 are formed on the outer side of the piezoelectric elements 32 and the common wires 38 are formed on the inner side. Then, individual corresponding resin core bumps 40 (described later) are joined to the separate wires 37 and the common wires 38. Further, in this embodiment, one of the common wires 38 extending from one of the rows of the piezoelectric elements 32, and the other of the common wires 38 extending from the other row of the piezoelectric elements 32 are connected to each other in the non-drive area 36 between the rows of the piezoelectric elements 32. That is, in the non-drive area 36 between the rows of the piezoelectric elements 32, the common wire 38 is formed so as to be common to both rows of the piezoelectric elements 32.

The sealing plate 33 (corresponding to the wiring substrate of the invention) is, as shown in FIG. 2, a flat plate type silicon substrate that is arranged at a distance from the diaphragm 31 (or the piezoelectric elements 32). In this embodiment, the sealing plate 33 is formed of a silicon single-crystal substrate, the crystal plane orientation of the surface (upper surface and lower surface) of which is the (110) plane. The driver IC 34 that outputs signals for driving the piezoelectric elements 32 is arranged on a second surface 42 (upper surface) of the sealing plate 33 on a side of the sealing plate 33 opposite to a first surface 41 (lower surface) of the sealing plate 33 on the diaphragm 31 side of the sealing plate 33. That is, the diaphragm 31 on which the piezoelectric elements 32 are stacked is connected to the first surface 41 of the sealing plate 33 and the driver IC 34 is arranged on the second surface 42 of the sealing plate 33.

A plurality of the resin core bumps 40 that output drive signals from the driver IC 34 or the like to the piezoelectric elements 32 are formed on the first surface 41 of the sealing plate 33 of this embodiment. The plurality of the resin core bumps 40 are, as shown in FIG. 2, respectively formed along individual nozzle row directions at a position corresponding to one of the separate wires 37 that extends to the outer part of one of the piezoelectric elements 32, at a position corresponding to the other one of the separate wires 37 that extends to the outer part of the other one of the piezoelectric elements 32, and at a position corresponding to the common wire 38 that is common to the plurality of piezoelectric elements 32 and that is formed between the two rows of the piezoelectric elements 32. Then, each of the resin core bumps 40 is connected to a corresponding one of the separate wires 37 and the common wire 38.

The resin core bumps 40 of this embodiment have elasticity and project toward the diaphragm 31 from the surface of the sealing plate 33. Specifically, as shown in FIG. 2, the resin core bumps 40 each have an internal resin portion 40*a* having elasticity and a conductive film portion 40*b* that is formed of a lower-surface-side wire 47 and that covers at least one portion of the surface of the internal resin portion 40*a*. The internal resin portions 40*a* are formed along the nozzle row direction and project from a surface of the sealing plate 33. Moreover, the conductive film portions 40*b* that conduct electricity to the separate wires 37 correspond to the piezoelectric elements 32 that are parallelly arranged along the nozzle row direction, and are formed in a plurality along the nozzle row direction. That is, the resin core bumps 40 that conduct electricity to the separate wires 37 are formed in a plurality along the nozzle row direction. Each of the conductive film portions 40*b* extends from the top of a corresponding one of the internal resin portions 40*a* toward the interior (the piezoelectric elements 32 side) and becomes a corresponding one of the lower-surface-side wires 47. Then, an end portion of each of the lower-surface-side wires 47 on the opposite side to the resin core bump 40 of the lower-surface-side wire 47 is connected to a through wire 45 that will be described later.

The resin core bump 40 that corresponds to the common wire 38 of this embodiment is, as shown in FIG. 2, formed in a plurality on a lower-surface-side embedded wire 51 embedded in the first surface 41 of the sealing plate 33. Specifically, the internal resin portions 40*a* are formed along the same direction as the lower-surface-side embedded wire 51 and each of the internal resin portions 40*a* is formed on the lower-surface-side embedded wire 51 that extends in the nozzle row direction so as to have a width smaller than the width (dimension in a direction orthogonal to the nozzle row direction) of the lower-surface-side embedded wire 51. Then, the conductive film portion 40*b* is formed so as to conduct electricity from the top of the internal resin portion 40*a* outward in both width directions of the internal resin portion 40*a* to the lower-surface-side embedded wire 51. The conductive film portion 40*b* is formed in a plurality along the nozzle row direction. That is, the resin core bump 40 that conducts electricity to the common wire 38 is formed in a plurality along the nozzle row direction. Further, as the internal resin portion 40*a*, for example, a resin such as polyimide resin or the like may be used. Moreover, the lower-surface-side embedded wire 51 may be composed of a metal such as copper (Cu) or the like.

The sealing plate 33 and the pressure-chamber-forming substrate 29 (in detail, the pressure-chamber-forming substrate 29 on which the diaphragm 31 and the piezoelectric elements 32 are stacked) are, as shown in FIG. 2, joined with photosensitive adhesive portions 43, which have both characteristics of a thermosetting property and photosensitivity, while having the resin core bumps 40 interposed therebetween. In this embodiment, the photosensitive adhesive portions 43 are formed on the two sides of each of the resin core bumps 40 in a direction orthogonal to the nozzle row direction. Moreover, each of the photosensitive adhesive portions 43 is formed as a strip in a direction along the nozzle row direction while being separated from the resin core bumps 40. Further, as the photosensitive adhesive portions 43, for example, a resin containing epoxy resin, acrylic resin, phenol resin, polyimide resin, silicone resin, styrene resin, or the like as the main component may be used as appropriate.

In the central portion of the second surface 42 of the sealing plate 33, as shown in FIG. 2, a power supply wire 53 (a type of wire) that supplies electrical power (power supply voltage) or the like (for example, VDD1 (low voltage circuit power supply), VDD2 (high voltage circuit power supply), VSS1 (low voltage circuit power supply), or VSS2 (high voltage circuit power supply)) to the driver IC 34 is formed in a plurality (in this embodiment, four). Each of the power supply wires 53 extends, in the nozzle row direction, that is, extends along the longitudinal direction of the driver IC 34, and is connected to an external power supply (not illustrated) or the like through a wiring substrate (not illustrated) such as a flexible cable at an end portion thereof in the longitudinal direction. Then, power supply bump electrodes 56 of the driver IC 34 (corresponding to the bump electrodes of this invention) are electrically connected to the top of the power supply wires 53. Further, a detailed description regarding the connection positions of the power supply wires 53 and the power supply bump electrodes 56 will be given later.

Furthermore, in regions at the two end sides of the second surface 42 of the sealing plate 33 (regions outwardly separated from the region in which the power supply wires 53 are formed), as shown in FIG. 2, separate connection terminals 54 to which signals from the driver IC 34 are input are formed and separate bump electrodes 57 of the driver IC 34 are connected thereto. The separate connection terminals 54 are formed in a plurality along the nozzle row direction so as to correspond to the piezoelectric elements 32. Upper-surface-side wires 46 each extend from a corresponding one of the separate connection terminals 54 toward the interior (the piezoelectric elements 32 side). An end portion of each of the upper-surface-side wires 46 on the opposite side to the separate connection terminals 54 side of the upper-surface-side wires 46 is connected to a corresponding one of the lower-surface-side wires 47 through a corresponding one of the through wires 45 to be described later.

The through wires 45 are wires that extend between the first surface 41 and the second surface 42 of the sealing plate 33, and are each formed of a through hole 45*a* that penetrates through the sealing plate 33 in the thickness direction and a conductive portion 45*b* that is composed of a conductive material such as a metal that is formed on the inside of the through hole 45*a*. The conductive portion 45*b* of this embodiment is composed of a metal such as copper (Cu) or the like and the inside of the through hole 45*a* is filled with the conductive portion 45*b*. The portion of the conductive portion 45*b* exposed at the opening on the first surface 41 side of the through hole 45*a* is covered by a corresponding one of the lower-surface-side wires 47. In contrast, the portion of the conductive portion 45*b* exposed at the opening on the second surface 42 side of the through hole 45*a* is covered by a corresponding one of the upper-surface-side wires 46. Consequently, the upper-surface-side wires 46 extending from the separate connection terminals 54 and the lower-surface-side wires 47 extending from the resin core bumps 40 corresponding thereto are electrically connected to each other by the through wires 45. That is, the separate connection terminals 54 and the resin core bumps 40 are connected to each other by a group of wires formed of the upper-surface-side wires 46, the through wires 45, and the lower-surface-side wires 47. Further, the conductive portions 45*b* of the through wires 45 do not have to completely fill the through holes 45*a*, and may be formed at the very least in a portion of the inside of the through holes 45*a*.

The driver IC 34 is an IC chip for driving the piezoelectric elements 32, and is stacked on the second surface 42 of the sealing plate 33 through an adhesive 59 such as an anisotropic conductive film (ACF). As shown in FIG. 2, on the surface of the driver IC 34 on the sealing plate 33 side of the driver IC 34, the power supply bump electrodes 56 connected to the power supply wires 53 and the separate bump electrodes 57 connected to the separate connection terminals 54 are parallelly arranged along the nozzle row direction. The voltage (electric power) from the power supply wires 53 is supplied to circuit blocks 61 formed in the driver IC 34 via the power supply bump electrodes 56 (refer to FIG. 4). The circuit blocks 61 are circuits that generate signals (drive signals) for individually driving each of the piezoelectric elements 32, and are formed in a plurality along the nozzle row direction. The separate bump electrodes 57 are connected to the output side of each of the circuit blocks 61, and the signals from individual ones of the circuit blocks 61 are respectively output to the separate bump electrodes 57, the separate connection terminals 54, and corresponding ones of the piezoelectric elements 32 via wires or the like formed in the sealing plate 33. The separate bump electrodes 57 and the circuit blocks 61 of this embodiment are formed in two rows on the outer sides of the group of the power supply bump electrodes 56 so as to correspond to the two rows of the piezoelectric elements 32 that are parallelly arranged. Further, regarding the space between the two rows of the separate bump electrodes 57, the center-to-center distance (namely, pitch) between adjacent ones of the separate bump electrodes 57 is made to be as small as possible, and, in this embodiment, is made to be smaller than the pitch of the resin core bumps 40.

The recording head 3 formed in the above manner introduces ink from the ink cartridge 7 to the pressure chambers 30 via ink introduction paths, the reservoirs 18, the common liquid chambers 25, and the separate communication paths 26. In this state, by supplying the drive signals from the driver IC 34 to the piezoelectric elements 32 via separate wires formed in the sealing plate 33, the piezoelectric elements 32 are driven and a pressure change is generated in the pressure chambers 30. By utilizing this pressure change, the recording head 3 ejects ink droplets from the nozzles 22 via the nozzle communication paths 27.

Figure 3:
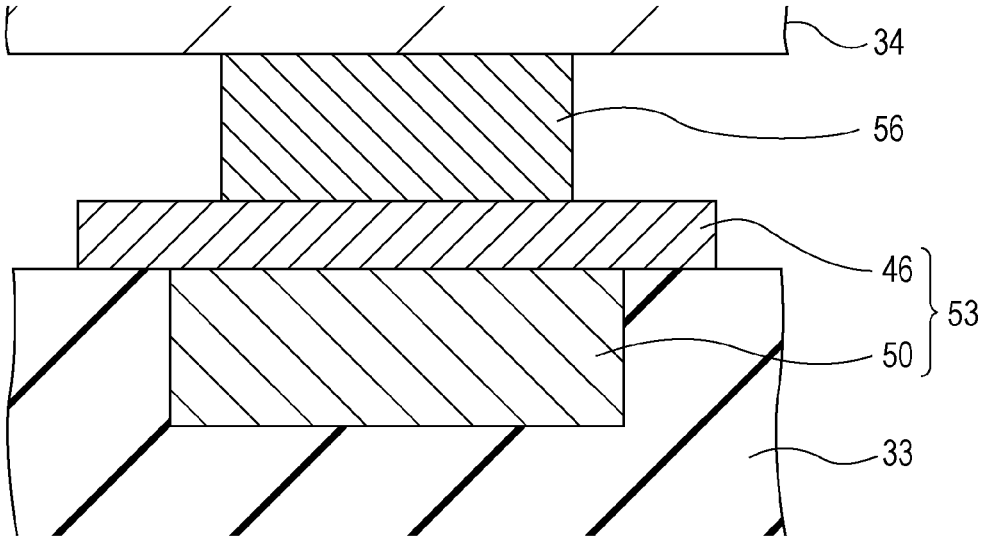
FIG. 3 is an enlarged cross-sectional diagram of a main part of an electronic device.
Figure 4:
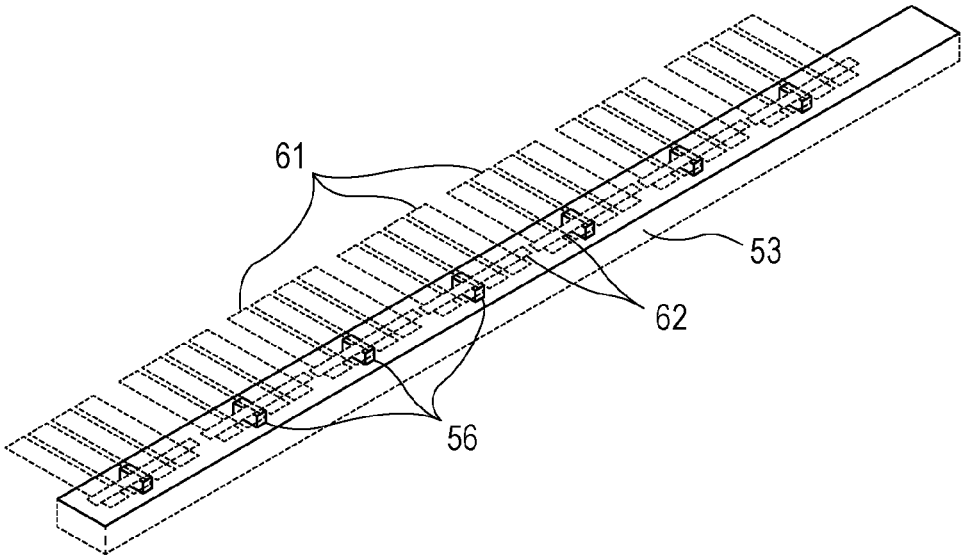
FIG. 4 is a perspective diagram illustrating a connection of a power supply wire and circuit blocks.

Next, a detailed description of the structure of the power supply wires 53 and the connection of the power supply wires 53 and the power supply bump electrodes 56 will be given. FIG. 3 is a diagram illustrating the joining portion of one of the power supply wires 53 and the driver IC 34 and is an enlarged cross-sectional diagram illustrating the main part of the electronic device 14. FIG. 4 is a schematic diagram illustrating the connection of one of the power supply wires 53 and the circuit blocks 61, and is a perspective diagram of the driver IC 34 seen from the sealing plate 33 side. Further, in FIG. 4, by omitting the sealing plate 33 and the driver IC 34, only the wire and the circuit can be seen. Moreover, below, an explanation is given focusing on one of the power supply wires 53 among the plurality of power supply wires 53.

First, the structure of the power supply wire 53 will be described. At least one part of the power supply wire 53 is embedded in the sealing plate 33 and the surface thereof is exposed on the second surface 42 side of the sealing plate 33. Specifically, the power supply wire 53 has, as illustrated in FIG. 3, an upper-surface-side embedded wire 50 (corresponding to the embedded wire of this invention) composed of a conductive material that is embedded in the second surface 42 of the sealing plate 33, and the upper-surface-side wire 46 (corresponding to the outer layer wire of this invention) composed of a conductive material that covers the upper-surface-side embedded wire 50 on the second surface 42 side of the upper-surface-side embedded wire 50. The upper-surface-side embedded wire 50 and the upper-surface-side wire 46 of this embodiment extend along the nozzle row direction up to the outer side of the driver IC 34 in the longitudinal direction, and are connected to a flexible cable or the like that is outside the driver IC 34. Further, as the upper-surface-side embedded wire 50, a metal such as copper (Cu) or the like is used. Moreover, as the upper-surface-side wire 46, a conductive material different from the upper-surface-side embedded wire 50 is used. As this conductive material, a material that is superior to the metal used in the upper-surface-side embedded wire 50 that has tolerance to environmental changes (temperature, humidity, and the like) is desirable, for example, a metal such as gold (Au) or the like is used.

In this way, by embedding the power supply wire 53 in the sealing plate 33, it is possible to increase the cross-sectional area of the power supply wire 53 without increasing the width of the power supply wire 53. As a result, it is possible to reduce the resistance of the power supply wire 53. Moreover, because it is possible to reduce the width of the power supply wire 53 as much as desired, the degree of freedom of the layout of the power supply wire 53 is improved and consequently the wire area can be made smaller. Furthermore, because it is possible to reduce the height of the power supply wire 53 from the surface of the sealing plate 33, it is possible to reduce the roughness of the surface of the sealing plate 33. Consequently, it becomes easy to mount the driver IC 34 on the sealing plate 33. Moreover, because the second surface 42 side of the power supply wire 53 is exposed, it is possible to connect the power supply bump electrodes 56 of the driver IC 34 directly to the top of the power supply wire 53 without having to additionally provide the power supply wire 53 with terminals. As a result, the wire distance from a power supply (not illustrated) or the like to the driver IC 34 can be decreased and the wire resistance can be reduced. In addition, because the upper-surface-side embedded wire 50 of the power supply wire 53 is covered by the upper-surface-side wire 46, it is possible to suppress a change in the electrical characteristics of the upper-surface-side embedded wire 50 due to environmental changes. Moreover, it is possible to suppress breakage of the upper-surface-side embedded wire 50 due to migration or the like. Consequently, it is possible to provide the recording head 3 having high reliability.

Next, the connection of the power supply wire 53 and the power supply bump electrodes 56 will be described. In this embodiment, as illustrated in FIG. 3 and FIG. 4, the plurality of the power supply bump electrodes 56 that are formed along the nozzle row direction are directly connected to the top of the power supply wire 53 (the upper-surface-side wire 46). In other words, the power supply bump electrodes 56 formed on the surface of the driver IC 34 on the lower surface side of the driver IC 34 (the sealing plate 33 side) are connected to the power supply wire 53 (the upper-surface-side wire 46) at a plurality of points along the nozzle row direction. Here, each of the power supply bump electrodes 56 is connected to at least one of the circuit blocks 61 among the plurality of the circuit blocks 61 parallelly arranged along the nozzle row direction in the driver IC 34. In this embodiment, as illustrated in FIG. 4, four of the circuit blocks 61 are connected to a corresponding one of the power supply bump electrodes 56 through a connection wire 62 (for example, an aluminum wire) in the driver IC 34. Consequently, the electrical power supplied from the power supply wire 53 is distributed to each of the circuit blocks 61 through a corresponding one of the power supply bump electrodes 56. As a result, compared with a related art structure, it is possible to suppress a power difference between individual ones of the circuit blocks 61 and, in turn, suppress a difference in the ejection characteristics of the ink ejected from the nozzles 22. A detailed description regarding this point is given below.

Figure 5A:
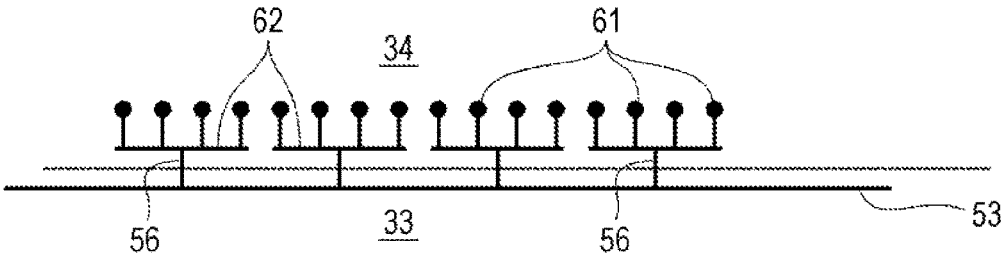
FIG. 5A is a schematic diagram illustrating a connection of a related art power supply wire and circuit blocks.
Figure 5B:
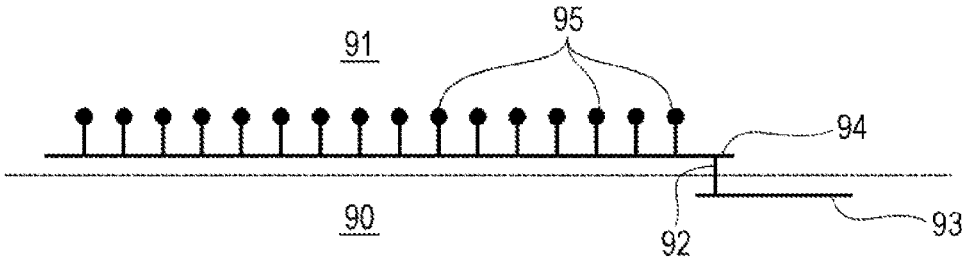
FIG. 5B (PRIOR ART)
FIG. 5B is a schematic diagram illustrating a connection of a power supply wire and circuit blocks of this embodiment.

FIGS. 5A and 5B are diagrams comparing this embodiment and a related art example with regard to the connection of one of the power supply wires 53 and the circuit blocks 61. FIG. 5A is a schematic diagram illustrating the connection of the power supply wire 53 and the circuit blocks 61 of this embodiment. FIG. 5B is a schematic diagram illustrating the connection of the power supply wire 53 and the circuit blocks 61 of a related art example.

As illustrated in FIG. 5B, a power supply wire 93 formed in a related art sealing plate 90 is, without extending along a direction parallel to circuit blocks 95 of a driver IC 91 (nozzle row direction), connected to a power supply bump electrode 92 at a position away from the row of the circuit blocks 95. Then, the power from the power supply wire 93 is supplied to each of the circuit blocks 95 via a connection wire 94 (for example, aluminum wire) in the driver IC 91 that extends along a direction parallel to the circuit blocks 95. Because of this, the connection wire 94 in the driver IC 91 becomes long and the power supplied decreases with increasing distance of the circuit blocks 95 from the power supply bump electrode 92 due to the resistance of the connection wire 94. As a result, the voltage waveform (drive waveform) output from the circuit blocks 95 becomes rounded, and the drive properties of the piezoelectric elements change. Then, due to this change in the drive characteristics, the ink ejection characteristics change and there is a concern that the ejection characteristics of ink ejected from the nozzles might vary.

In contrast, in this embodiment, as illustrated in FIG. 5A, the power supply wire 53 extends along a direction parallel to the circuit blocks 61, and because the power is distributed to each of the circuit blocks 61 via the plurality of the power supply bump electrodes 56 arranged parallelly in the aforementioned direction, it is possible to suppress a decrease in the power supplied to each of the circuit blocks 61. That is, because the power supply wire 53 is embedded in the sealing plate 33, it is possible to decrease the resistance of the power supply wire 53 and it is possible to suppress a decrease in the power along a direction parallel to the circuit blocks 61. Then, by arranging a plurality of the power supply bump electrodes 56 along a direction parallel to the circuit blocks 61 and by establishing a plurality of contact points for the power supply wire 53, it is possible to shorten the wire distance between each of the circuit blocks 61 and the power supply wire 53, and it is possible to reduce the resistance between each of the circuit blocks 61 and the power supply wire 53. Consequently, it is possible to make the amounts of power supplied to individual ones of the circuit blocks 61 that are parallelly arranged substantially equal. Further, in the above description, one of the power supply wires 53 and the power supply bump electrodes 56 connected thereto are exemplified, however, because the other one of the power supply wires 53 and the power supply bump electrodes 56 connected thereto are the same, description thereof is omitted.

Next, a method of manufacturing the recording head 3 described above, in particular, the sealing plate 33, will be described. The electronic device 14 of this embodiment is obtained by joining a silicon single-crystal substrate (silicon wafer) that has a plurality of regions that will each become the sealing plate 33 and a silicon single-crystal substrate (silicon wafer) that has a plurality of regions that will each become the pressure-chamber-forming substrate 29 that has the diaphragm 31 and the piezoelectric elements 32 stacked thereon, and, after joining the driver IC 34 at a position corresponding to each of these regions, cutting the joined structure into individual pieces.

Figure 6A:
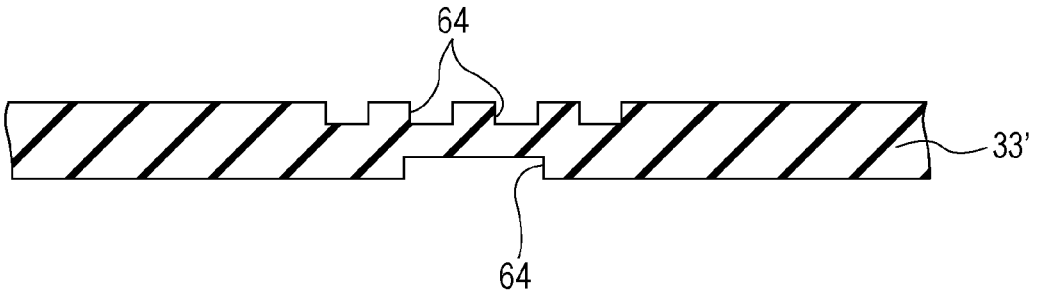
FIGS. 6A to 6C are cross-sectional diagrams illustrating a process of manufacturing a sealing plate.
Figure 6B:
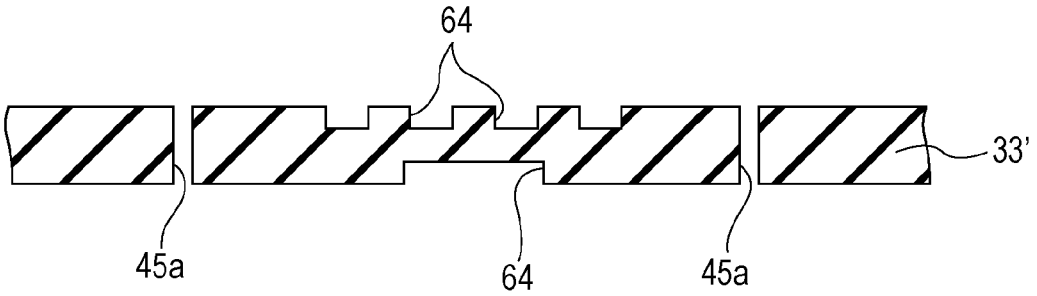

When explained in detail, in a silicon single-crystal substrate 33' on the sealing plate 33 side, firstly, in a wiring substrate processing process, recessed portions 64 for forming the upper-surface-side embedded wires 50 and the lower-surface-side embedded wire 51 are formed on both surfaces of the silicon single-crystal substrate 33' by a photolithography process and an etching process, and the through holes 45*a* that penetrate through the sealing plate 33 are formed. Specifically, a photoresist is patterned on either surface of the silicon single-crystal substrate 33' and the recessed portions 64 that are recessed in the thickness direction by performing dry etching are formed. Likewise, a photoresist is patterned on the other surface and the recessed portions 64 that are recessed in the thickness direction by performing dry etching are formed (refer to FIG. 6A). Next, a photoresist is patterned, and the points at which the through holes 45*a* are to be formed in the surface of the silicon single-crystal substrate 33' are exposed. Subsequently, the through holes 45*a* are formed by etching these exposed portions in the thickness direction by dry etching. Thereafter, the photoresist is detached and an insulating film (not illustrated) is formed on the sidewalls of the through holes 45*a* (refer to FIG. 6B). Further, as the method of forming the insulating film, various kinds of methods such as a CVD method, a method of forming a silicon oxide film by heat oxidation, and a method of applying and curing a resin can be used.

Figure 6C:
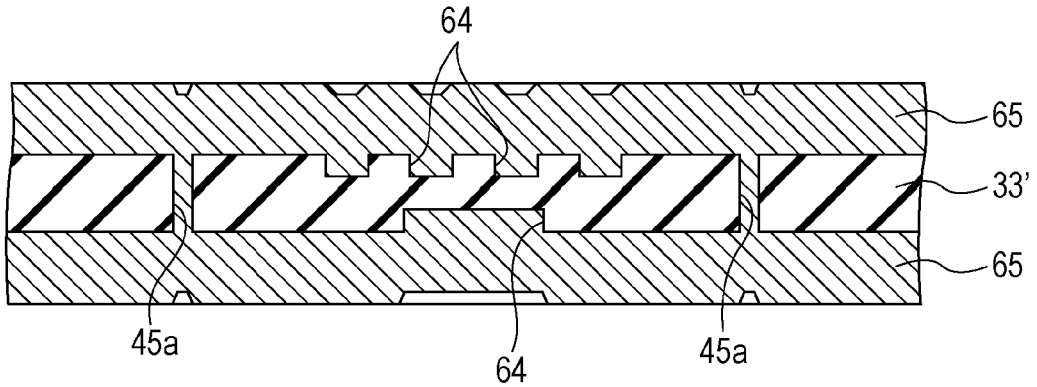

Next, in the wire manufacturing process, the upper-surface-side embedded wires 50 and the lower-surface-side embedded wire 51 are formed by filling the recessed portions 64 with a conductive material 65, and the through wires 45 are formed by filling the through holes 45*a* with the conductive material 65. Specifically, the conductive material 65 that becomes the upper-surface-side embedded wires 50, the lower-surface-side embedded wire 51 and the conductive portions 45*b* of the through wires 45 in the through holes 45*a* and on both surfaces of the silicon single-crystal substrate 33' is formed by an electroplating method. That is, a seed layer for forming the conductive material 65 is formed and the conductive material 65 is formed by electrolysis copper plating using the seed layer as an electrode (refer to FIG. 6C). Further, it is preferable to form below the seed layer a film that improves the adhesive characteristics and the barrier characteristics of the substrate. Moreover, it is desirable to form copper (Cu) as the seed layer, and titanium (Ti), titanium nitride (TiN), titanium tungsten (TiW), tantalum (Ta), tantalum nitride (TaN) or the like as the adhesive layer or barrier layer, and the like by using a sputtering method or a CVD method. Furthermore, as the method of forming the conductive material, the conductive material may be formed by filling the recessed portions 64 and the through holes 45*a* with a material that can realize vertical conduction by using a method such as non-electrolysis plating, conductive paste printing, or the like, without resorting to electrolysis copper plating.

Figure 7A:
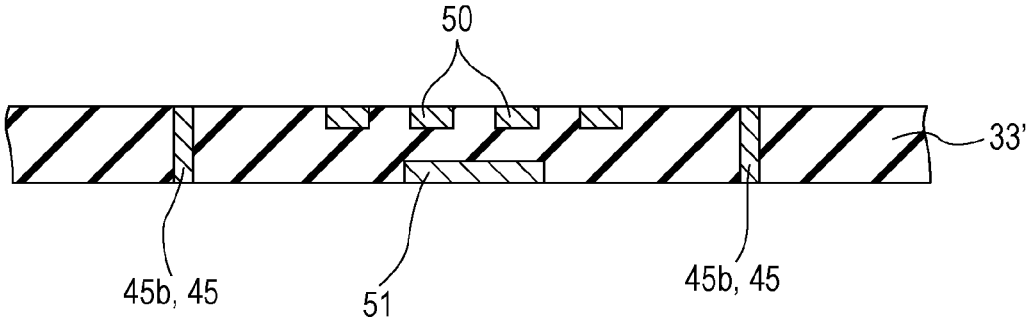
FIGS. 7A to 7C are cross-sectional diagrams illustrating a process of manufacturing a sealing plate.
Figure 7B:
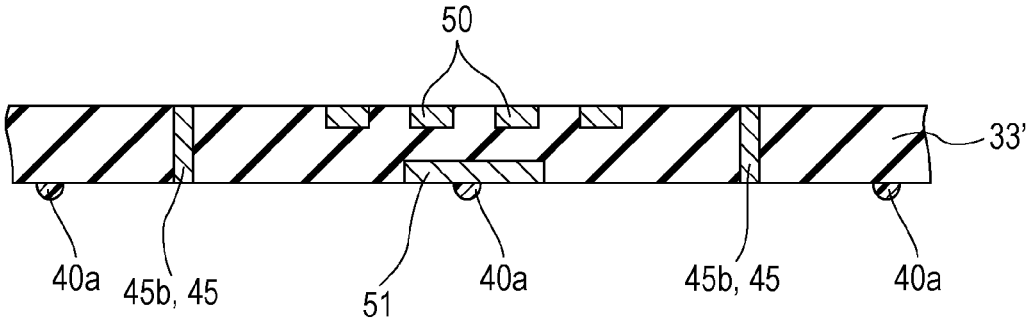

Next, the conductive material 65 (copper (Cu)) deposited on the upper surface of the silicon single-crystal substrate 33' is removed using a chemical mechanical planarization (CMP) method, and the surface of the silicon single-crystal substrate 33' is exposed. Moreover, the lower surface of the silicon single-crystal substrate 33' is removed up to a certain thickness by a back-grind method or the like and, finally, by grinding the silicon single-crystal substrate 33' by using a CMP method or the like the conductive portions 45*b* of the through wires 45 are exposed (refer to FIG. 7A). Thus, the upper-surface-side embedded wires 50, the lower-surface-side embedded wire 51 and the through wires 45 are formed in the silicon single-crystal substrate 33'. After the wires 50, 51, and 45 have been formed, an insulating film (not illustrated) such as a silicon oxide film is formed on the bottom surface of the silicon single-crystal substrate 33'. Then, a photoresist is patterned, and, after the lower-surface-side embedded wire 51 and the through wires 45 have been exposed by dry etching or wet etching, the photoresist is detached. After that, a resin film is formed on the lower surface of the silicon single-crystal substrate 33', and after the internal resin portions 40*a* have been formed by a photolithography process and an etching process, the internal resin portions 40*a* are melted by heating and the corners thereof are rounded (refer to FIG. 7B).

Figure 7C:
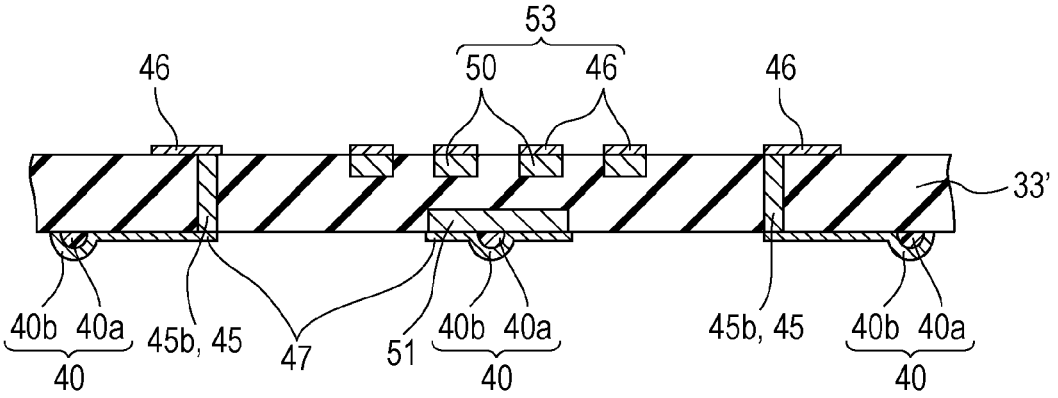

After forming the internal resin portions 40*a*, in the outer layer wire formation process, a re-wiring layer that is composed of a conductive material that is different from the conductive material 65 described above is formed over the entirety of the upper surface of the silicon single-crystal substrate 33', and by patterning the re-wiring layer by a photolithography process and an etching process, the upper-surface-side wires 46 that cover the upper-surface-side embedded wires 50 are formed. Likewise, the re-wiring layer that is composed of a conductive material that is different from the conductive material 65 described above is formed over the entirety of the lower surface of the silicon single-crystal substrate 33', and by patterning the re-wiring layer by a photolithography process and an etching process, the lower-surface-side wire 47 that covers the lower-surface-side embedded wire 51 is formed. Further, at the same time as this, because the conductive film portions 40*b* are also formed, the resin core bumps 40 are formed (refer to FIG. 7C). As a result, regions that are to become the sealing plates 33 corresponding to individual ones of the recording head 3 are formed in the silicon single-crystal substrate 33'. Further, as the material of the re-wiring layer, it is preferable for the outermost surface to be formed of gold (Au), however, the material is not limited to this and may be formed using a commonly used material (Ti, Al, Cr, Ni, Cu, or the like). Moreover, the method of forming the upper-surface-side wires 46, the lower-surface-side wires 47 and the through wires 45 in the sealing plate 33 is not limited to the above-described method and a common available manufacturing method may be used instead.

Firstly, the diaphragm 31 is stacked on the surface of the silicon single-crystal substrate on the pressure-chamber-forming substrate 29 side (the surface that faces the sealing plate 33). Next, by a semiconductor process, the lower electrode layer that includes the separate wires 37, the piezoelectric layer and the upper electrode layer including the common wire 38, and the like are patterned in order and the piezoelectric elements 32 are formed. Consequently, a region that is to become the pressure-chamber-forming substrate 29 corresponding to the recording head 3 is formed in a plurality in the silicon single-crystal substrate. Then, after forming the sealing plate 33 and the pressure-chamber-forming substrate 29 in individual silicon single-crystal substrates, a photosensitive adhesive layer is formed on the surface (the sealing plate 33 side surface) of the silicon single-crystal substrate on the pressure-chamber-forming substrate 29 side and the photosensitive adhesive portions 43 are formed at certain positions by a photolithography process. Specifically, a photosensitive adhesive in a liquid state having photosensitivity and a thermosetting property is applied on the diaphragm 31 by using a spin coater or the like and a photosensitive adhesive layer is formed by heating the photosensitive adhesive. Then, the shapes of the photosensitive adhesive portions 43 are patterned at certain positions by exposing and developing the photosensitive adhesive portions 43.

After forming the photosensitive adhesive portions 43, both of the silicon single-crystal substrates are joined. Specifically, either one of the silicon single-crystal substrates is moved toward the other silicon single-crystal substrate, and the photosensitive adhesive portions 43 are arranged between the silicon single-crystal substrates and bonded thereto. In this state, both of the silicon single-crystal substrates are vertically pressed against the elastic restoring force of the resin core bumps 40. Consequently, the resin core bumps 40 are crushed and it is possible to reliably ensure conduction between the resin core bumps 40 and the separate wires 37 and the common wire 38 on the pressure-chamber-forming substrate 29 side. Then, while increasing pressure, heating is performed up to the curing temperature of the photosensitive adhesive portions 43. As a result, in a state where the resin core bumps 40 are crushed, the photosensitive adhesive portions 43 are cured and both of the silicon single-crystal substrates are joined to each other.

After both of the silicon single-crystal substrates have been joined to each other, the silicon single-crystal substrate on the pressure-chamber-forming substrate 29 side is polished from the lower surface side (the side opposite to the sealing plate 33 side of the silicon single-crystal substrate) and the silicon single-crystal substrate on the pressure-chamber-forming substrate 29 side is thinned. After that, the pressure chambers 30 are formed in the silicon single-crystal substrate on the pressure-chamber-forming substrate 29, which has been thinned, side by a photolithography process and an etching process. Then, the driver IC 34 is joined to the upper surface side of the silicon single-crystal substrate on the sealing plate 33 side using the adhesive 59. Finally, scribing is performed along certain scribe lines and individual ones of the electronic devices 14 are cut. Further, in the above-described method, the electronic device 14 is manufactured by joining two silicon single-crystal substrates into a single piece; however, the method of manufacturing the electronic device 14 is not limited to this one. For example, the sealing plate 33 and the pressure-chamber-forming substrate 29 may first be diced into individual pieces and then joined to each other. Moreover, after dicing several silicon single-crystal substrates into individual pieces, the sealing plate 33 and the pressure-chamber-forming substrate 29 may be formed in these diced substrates.

Then, the electronic device 14 manufactured by the above-described process is positioned and fixed to the flow path unit 15 (the communication substrate 24) by using an adhesive agent or the like. Then, in a state where the electronic device 14 is housed in the housing space 17 of the head case 16, the recording head 3 that is described above is manufactured by joining the head case 16 and the flow path unit 15.

In this way, the recessed portions 64 that are recessed in the thickness direction are manufactured and because the inside of the recessed portions 64 is filled with the conductive material 65, it is possible to manufacture the power supply wires 53 that are embedded inside the sealing plate 33. Consequently, it is possible to increase the cross-sectional area of each of the power supply wires 53 without widening the width of each of the power supply wires 53. As a result, it is possible to decrease the resistance of the power supply wires 53. Moreover, because it is possible to form the power supply wires 53 and the through wires 45 using the same method, the manufacturing of the sealing plate 33 becomes easy. Furthermore, it is possible to reduce the manufacturing costs of the sealing plate 33. Moreover, because the conductive material 65 is formed inside the recessed portions 64 and the through holes 45*a* by an electroplating method, it is possible to form the power supply wires 53 and the through wires 45 even more easily. As a result, the manufacturing of the sealing plate 33 becomes even easier. Moreover, it is possible to further reduce the manufacturing costs of the sealing plate 33. Furthermore, in the outer layer wire formation process, because the second surface 42 side of the upper-surface-side embedded wires 50 is covered by the upper-surface-side wires 46, it is possible to suppress a change in the electrical characteristics of the upper-surface-side embedded wires 50 due to environmental changes. Moreover, it is possible to suppress breakage of the upper-surface-side embedded wires 50 due to migration or the like. Consequently, it is possible to provide the recording head 3 having high reliability.

In the above-described embodiment, four of the circuit blocks 61 were connected to one of the power supply bump electrodes 56 through the connection wire 62 inside the driver IC 34, however, the structure is not limited to this. For example, one circuit block may be connected to one power supply bump electrode. In such a case, the circuit blocks and the power supply bump electrodes are disposed along the nozzle row direction and connected to individual power supply wires. In conclusion, a circuit block and a power supply bump electrode connected to at least one circuit block are provided in a plurality along the nozzle row direction, and each power supply bump electrode may be connected to a power supply wire.

Moreover, in the above-described embodiment, the separate connection terminals 54 and the resin core bumps 40 are arranged at equal intervals along the nozzle row direction (first direction), however, the arrangement is not limited to this. An arrangement in which individual connection terminals and bump electrodes are not arranged at equal intervals along the nozzle row direction can be applied to the invention. In brief, the individual connection terminals and bump electrodes may be arranged at intervals apart from each other. Moreover, in the above-described embodiment, the resin core bumps 40 were provided on the sealing plate 33 side, however, the arrangement is not limited to this. For example, it is possible to provide the resin core bumps 40 on the pressure chamber substrate side. Furthermore, in the above-described embodiment, as the bump electrodes, the resin core bumps 40 formed of the internal resin portion 40*a* and the conductive film portion 40*b* were used, however, the structure is not limited to this. For example, it is possible to use bump electrodes formed of a metal such as gold (Au), solder or the like. Moreover, in the above-described manufacturing method, the photosensitive adhesive portions 43 were applied on the silicon single-crystal substrate on the pressure-chamber-forming substrate 29 side; however, the structure is not limited to this. For example, it is also possible to apply the photosensitive adhesive to the silicon single-crystal substrate on the sealing plate side.

In the above description, as the liquid ejecting head, an ink jet type recording head mounted in an ink jet printer was given as an example, however, it is possible to use something that ejects a liquid other than ink. For example, it is possible to apply the invention to a color material ejecting head used for the manufacture of color filters such as those of liquid crystal displays, an ejecting head used in the manufacture of electrode structures such as those of an organic electroluminescence (EL) display, a field effect display (FED), a bioorganic substance ejecting head used in the manufacture of biochips or the like.

This application is a division of U.S. application Ser. No. 15/006,756 filed Jan. 26, 2016, which claims priority to Japanese Patent Application No. 2015-046946, filed Mar. 10, 2015, the entireties of which are incorporated by reference herein.

What is claimed is:

1. A method of manufacturing a liquid ejecting head that has a wiring substrate having a first surface that is connected to a driver-element-forming substrate in which rows and a plurality of driver elements are provided, a part of the plurality of driver elements being included in the rows, and a second surface that is on the opposite side to the first surface and that is provided with a driver IC that outputs signals that drive the driver elements in the rows, a wire in the second surface that supplies electrical power to the driver elements and a through wire that extends between the first surface and the second surface, the method comprising:

processing the wiring substrate so as to form a recessed portion that is recessed in the second surface of the wiring substrate in a thickness direction thereof and a through hole that penetrates through the wiring substrate, the wiring substrate being a board made of a silicon single crystal substrate, and forming the wire by filling a conductive material into the recessed portion and the through wire by filling the conductive material into the through hole.

2. The method of manufacturing a liquid ejecting head according to claim 1, wherein the forming of the wire involves forming the conductive material in the recessed portion and the through hole by electroplating.

3. The method of manufacturing a liquid ejecting head according to claim 1 further comprising:

forming an outer layer wire that covers the second surface side of the wire embedded in the wiring substrate with a conductive material that is different from the conductive material of the wire embedded in the wiring substrate.

* * * * *